US005722628A

United States Patent [19]

Menaged

[11] Patent Number: 5,722,628

[45] Date of Patent: Mar. 3, 1998

[54] COLLAPSIBLE VARIABLE POSITION READING STAND

[76] Inventor: David L. Menaged, 12260 SW. 40th St., Miami, Fla. 33175

[21] Appl. No.: 496,357

[22] Filed: Jun. 29, 1995

[51] Int. Cl.[6] ..... A47B 97/04

[52] U.S. Cl. ..... 248/441.1; 211/50; 248/455; 248/459; 248/460

[58] Field of Search ..... 248/459, 460, 248/454, 455, 451, 441.1; 211/50

[56] References Cited

U.S. PATENT DOCUMENTS

| | | | |
|---|---|---|---|
| 3,410,516 | 11/1968 | Criswell | 248/459 |
| 4,544,123 | 10/1985 | Peacock | 248/460 |
| 4,555,128 | 11/1985 | White et al. | 248/451 X |
| 4,607,817 | 8/1986 | Aquino | 248/459 |
| 4,709,895 | 12/1987 | Mardak | 248/459 X |
| 4,886,231 | 12/1989 | Doerksen | 248/441.1 X |
| 4,964,519 | 10/1990 | Sugarman et al. | 211/50 |
| 5,116,012 | 5/1992 | Offenhauer et al. | 211/50 X |

*Primary Examiner*—Derek J. Berger
*Attorney, Agent, or Firm*—Robert M. Downey, P.A.

[57] ABSTRACT

A portable, collapsible reading stand for supporting a book, magazine or other sheet reading materials includes a blank of substantially rigid material having adjacently positioned panels hingedly movable relative to one another and including a base panel, a first panel group and a second panel group. The first panel group is structured for upward and rearward sloping of a frontal panel thereof throughout a range of angular, adjusted positions relative to the base panel. The second group of panels is structured to provide a support lip adjacent a lower portion of the frontal panel, the support lip being movable through a range of angular adjusted positions relative to the frontal panel so as to support a bottom edge of the reading materials. At least one of the panels accommodates a tape flag dispenser housing for providing tape flags in order to mark pages of the reading material.

5 Claims, 2 Drawing Sheets

COLLAPSIBLE VARIABLE POSITION READING STAND

BACKGROUND OF THE INVENTION

1. Field of the Invention

The present invention relates to reading stands, and more particularly, to a reading stand which is formed from a blank of rigid sheet material having a plurality of panels and having means to adjust the angular position of the panels to a preferred viewing orientation which is comfortable for the reader, with at least one of the panels having means thereon to accommodate a tape flag dispenser.

2. Description of the Related Art

The related art is crowded with a wide variety of book stands, display devices, document holders and the like. Some of these devices are fixed structures, while others are designed to be portable and collapsible so that they may be easily packaged for transport and collapsed for carrying by the user.

Some of the less expensive, more economical reading stands and like devices in the art are made from a blank of sheet material, such as cardboard or plastic. Pre-formed seams and interlocking notches enable the stands to be collapsed during non-use and folded into an operative position when it is desired to support various reading material or documents thereon.

While some of the various devices in the related art have been found to be extremely useful and practical, they are primarily directed to achieve one purpose, namely the supporting or positioning of books, magazines, documents and other reading material in a preferred viewing orientation.

Recently, tape flags, comprised of a color cellophane or like material strip with an adhesive portion thereon, have become a popular means for marking pages (or the location on a page) of a book, magazine and the like. Ordinarily, tape flags are provided in a plastic dispenser housing which is structured to dispense the flags one at a time. The reading stands and like devices in the related art fail to provide a means to support such a tape flag dispenser on the device for convenience to the user when the need arises to mark pages of the material supported on the reading stand.

Accordingly, there is a need in the reading stand art for a portable, collapsible, inexpensive reading stand providing means to accommodate a tape flag dispenser thereon in a manner which is convenient and accessible to the use and which provides for removal and replacement of empty flag dispensers.

OBJECT AND ADVANTAGES OF THE INVENTION

It is an object of the present invention to provide a portable reading stand which permits a user to adjust the angular position of the panels and reading material supported thereon, to a select viewing orientation which is comfortable for the reader.

It is another object of the present invention to provide a portable reading stand which is readily collapsible and which can be folded to the size of a standard notebook.

It is still another object of this invention to provide a device which includes means for accommodating a tape flag dispenser thereon.

It is yet another object of this invention to provide such a device that is inexpensive to manufacture from a blank of rigid sheet material.

Further objects and advantages of the invention will be more readily apparent in the following detailed description.

BRIEF DESCRIPTION OF THE DRAWINGS

With the above and other related objects in view, the invention comprises the details of construction and combination of parts as will be more fully understood from the following detailed description, when read in conjunction with the accompanying drawings in which.

Like reference numerals refer to like parts throughout the several views of the drawings.

DETAILED DESCRIPTION OF THE PREFERRED EMBODIMENT

Figure 1:
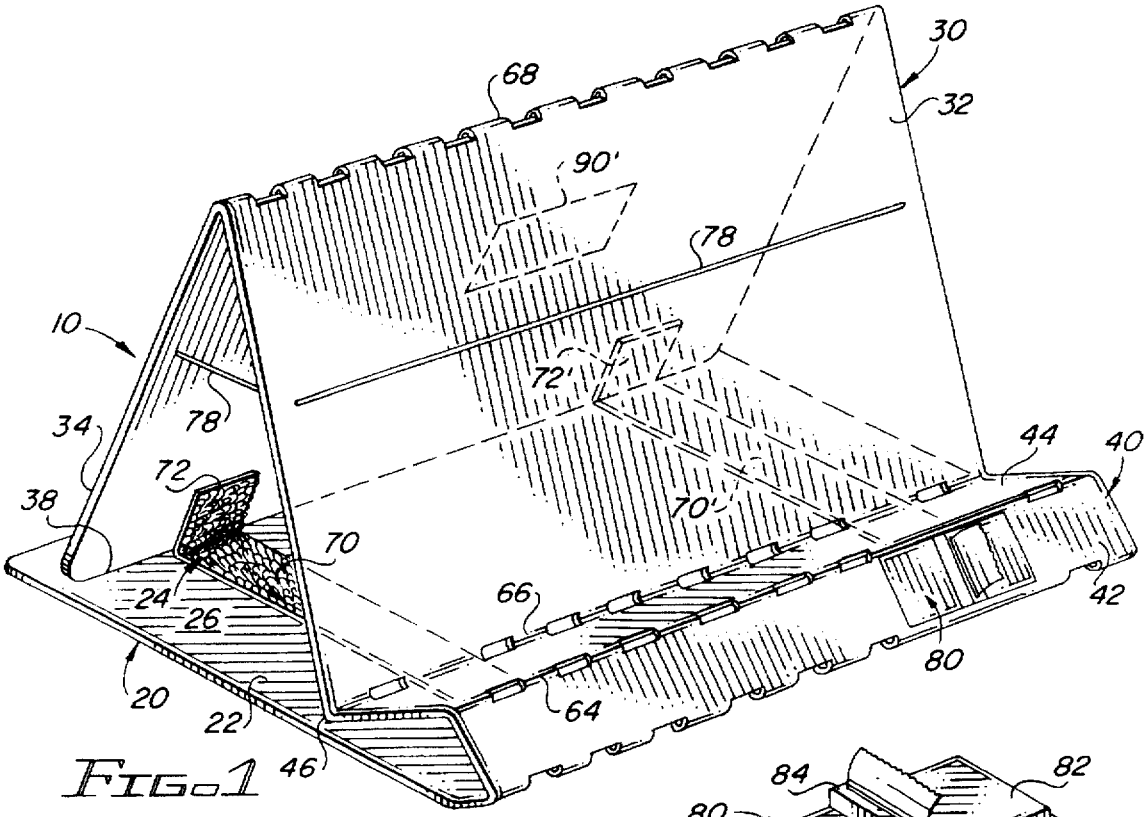
FIG. 1 is a front perspective view of a preferred embodiment of the reading stand of the present invention.

Referring now to the drawings, where the present invention is generally referred to with numeral 10, it can be observed that the reading stand 10 includes base panel group 20, first panel group 30 and second panel group 40.

Figure 2:
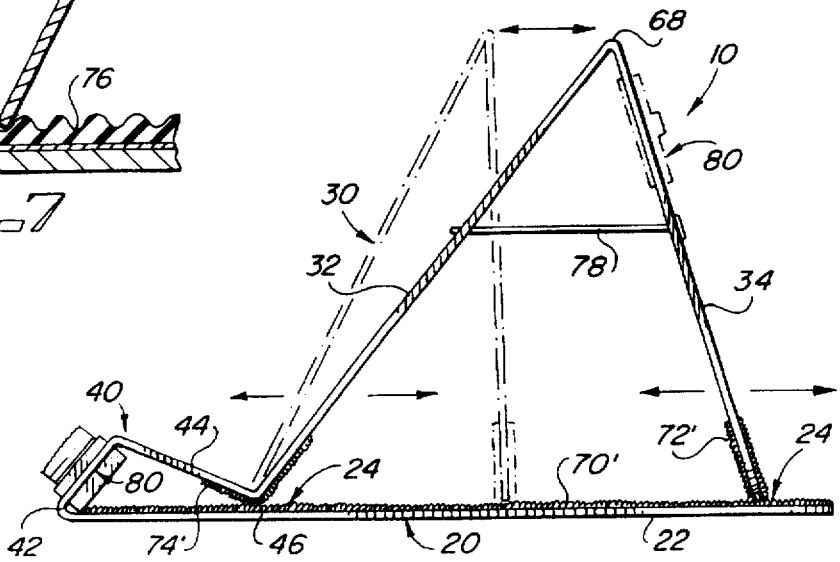
FIG. 2 is a side view of the reading stand illustrating movement of the front and rear panels to facilitate angular adjustment thereof.
Figure 3:
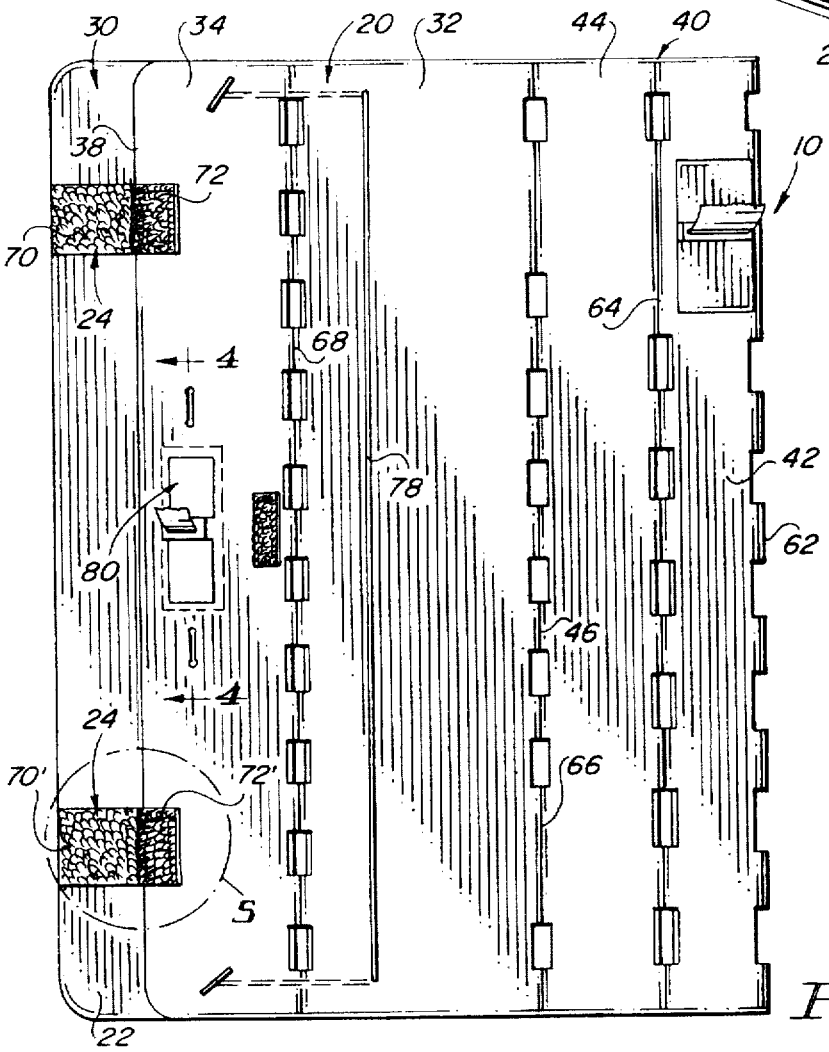
FIG. 3 is a top plan view of the reading stand of FIG. 1.

As shown in FIGS. 1–3, the base panel group 20 includes a base panel 22, having adjustment means 24 on an upper surface 26 thereof. The first panel group 30 includes a frontal panel 32, and a rear panel 34 having a lower free edge 38. The rear panel 34 is structured and disposed for upward and rearward sloping support of frontal panel 32. It can also be observed that second panel group 40 comprises an angled panel 42, support lip 44 and a lower longitudinal crease 46 defining a hinge 66 between the support lip 44 and frontal panel 32.

In the preferred embodiment, the reading stand 10 is constructed from a blank of corrugated sheet material. This material is inexpensive and can easily be creased so as to form hinges 62, 64, 66 and 68. The hinges can be punched or stamp cut to formed cutouts, eliminating material along the crease and thereby increasing the flexibility of the hinges.

Referring now to FIG. 2, it can be seen that the viewing orientation of reading material supported on the stand 10 may be changed by altering the angular positions of frontal panel 32 and support lip 44, which cooperatively support the reading material. The frontal panel 32 and support lip 44 may be adjusted by changing the positions at which the lower edge 38 and crease 46 engage the adjustment means 24 on the base panel 22. A user desiring to employ the reading stand 10 will fold the corrugated sheet material along the hinges such that the edges 38 and 46 engage the adjustment means 24, as best seen in FIG. 2. It is also apparent from FIG. 2 that the relative position of frontal panel 32 may be changed by adjusting the positions at which the lower edge 38 of the rear panel 34 engages the adjustment means 24. It can also be seen that the position of support lip 44, and consequently the frontal panel 32, can be changed by altering the position at which the longitudinal crease 46 engages the adjustment means 24. The reading stand 10 is structured to readily fold up for carrying and storage after use. A user desiring to collapse the reading stand 10 may do so by folding the stand 10 along hinges 62 and 68 so that the panels are disposed in a flat, coplanar, stacked orientation.

Figure 5:
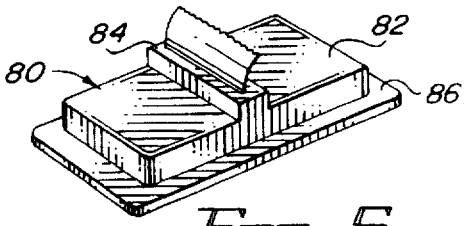
FIG. 5 is a perspective view of a tape flag dispenser used in connection with the reading stand.
Figure 7:
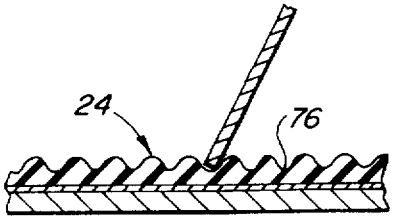
FIG. 7 is an isolated sectional view showing an alternative embodiment of the adjustment means comprising a corrugated rubber strip.

In a preferred embodiment, the adjustment means 24 includes hook and loop fasteners, including a pair of hook or loop fabric strips 70, 70' disposed in spaced, parallel relation on the upper surface 26 of the base panel 22, being specifically positioned and disposed for releasable engagement with a corresponding hook or loop fabric element 72, 72' fitted to the free bottom edge 38 of the rear panel 34. As best seen in FIG. 5, the hook or loop fabric element 72 can be selectively placed at any position along the length of the strip 70 for selective, angular positioning of the first panel group 30.

The seam or crease 46 is further provided with a pair of spaced hook and loop fabric elements 74, 74'(74 not shown) specifically positioned for engagement with the corresponding hook or loop fabric strips 70, 70' for selective adjustment of the support lip 44 and frontal panel 32, as described above.

In an alternative embodiment, the adjustment means 24 includes a pair of corrugated strips 76, formed of a resilient material and adhered to the upper surface 26 of the base panel 22. The corrugated construction of the rubber strip forms a series of ridges and troughs, providing a means to engage the lower edge 38 and the crease 46 at various selected, adjusted positions.

An elastic strap 78 is anchored at opposite ends to the rear panel 34 and extends through the frontal panel 32, so that a mid-section of the strap 78 extends transversely across the exposed surface of the frontal panel 32. When the first panel group 30 is positioned in an operative position, as seen in FIGS. 1 and 2, the mid-section of the strap 78 is pulled taut against the exposed surface of the frontal panel 32. The reading materials supported against the frontal panel 32 can then be placed behind the strap 78 by pulling the strap outwardly and inserting the reading materials between the strap 78 and frontal panel 32, so that when released, the strap 78 extends across the exposed surface of the reading materials preventing them from being moved or dislodged from their supported, preferred viewing orientation.

Figure 4:
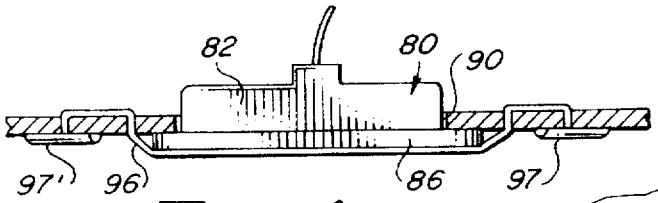
FIG. 4 is an isolated sectional view taken along the plane 4—4 of FIG. 3 showing a tape flag dispenser fitted within a lower angled panel and held therein with securing means.
Figure 6:
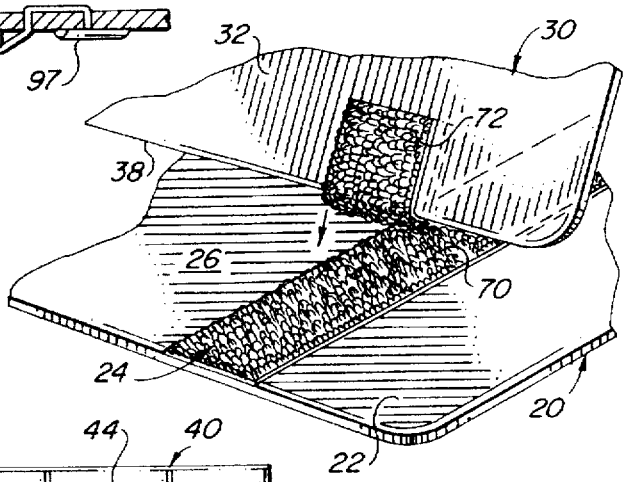
FIG. 6 is an isolated perspective view, taken from the area indicated as 6 in FIG. 3, of an adjustment means comprising hook and loop fastening means.

Referring to FIGS. 4 and 5, an important feature of the present invention is illustrated. Specifically, there is provided a means on at least one of the panels of the reading stand 10 for attaching and maintaining a tape flag dispenser housing 80 on the panel so that an upper portion 82 and flag dispensing slot 84 are positioned and disposed exteriorly of the panel. As seen in FIGS. 1 and 2, a preferred panel for accommodating the flag dispenser housing 80 is the lower angled panel 42, in that this panel normally faces the user and remains unobstructed during use. The means for accommodating the dispenser housing 80 is comprised of a cutout portion 90 in at least one of the panels. A second cutout portion 90' may be provided on another panel, such as the rear panel 34 (see FIG. 1) to accommodate a spare flag dispenser housing.

A flange 86, around the base of the housing 80, engages the inner surface of the panel about the periphery of the cutout portion when the housing 80 is fitted therein, preventing the housing 80 from passing through the cutout portion.

As seen in FIG. 4, a securing means 94 comprises an elastic strap 96 which is anchored to the panel at opposite ends 97, 97' so that a mid-length of the strap 96 extends across the cutout portion 90. In this manner, the tape flag dispenser housing 80 properly positioned within the cutout portion so that the upper portion 80 to the housing protrudes therethrough, the strap 96 extends across and engages a bottom surface of the tape flag dispenser housing 80 urging it so that a shoulder, defined by the surrounding flange, engages the surface of the panel surrounding the cutout portion. Alternatively, tape or other securing means can be used to hold the housing 80 within the cutout portion 90.

While the instant invention has been shown and described in what is considered to be preferred and practical embodiments thereof, it is recognized that the invention is not to be limited in scope except as set forth in the following claims and within the Doctrine of Equivalents.

Now that the invention has been described:

What is claimed is:

1. A reading stand for supporting reading materials having one or more pages, the reading stand comprising:

a blank of rigid sheet material having a plurality of adjacently positioned panels including a base panel having an upper surface, a first group of panels and a second group of panels, hinge means between each of said adjacently positioned panels for allowing angular folding movement of each of said panels relative to a remainder of said panels, said first group of panels including a frontal panel and being structured and disposed for upward and rearward sloping support of said frontal panel throughout a range of angular, adjusted positions relative to said base, said second group of panels being hingedly movable for arrangement through a range of adjusted positions to provide a support lip adjacent a lower portion of said frontal panel and cooperating with said frontal panel to receive and support the reading materials selectively in one of a range of preferred viewing orientations, said support lip being angularly adjustable relative to said frontal panel so as to engage and capture a lower edge of the pages of the reading materials, adjustment means on said upper surface of said base panel for selectively adjusting and maintaining said frontal panel and said support lip at a select one of said range of adjusted positions, a tape flag dispenser housing structured to contain a predetermined quantity of tape strips in stacked relation therein and including an upper portion with a dispensing slot sized and configured for passage of individual ones of the tape strips therethrough for individual dispensing thereof, said housing further including a flanged base defining a shoulder about a base of the upper portion, means formed in at least one of said panels for attaching said housing thereto and including a cutout portion sized and configured for passage of the upper portion of said housing therethrough so that said shoulder engages an inner surface of said at least one panel about a periphery of said cutout portion with said dispensing slot exteriorly disposed to facilitate grasping and retrieval of one of the tape strips therefrom, and securing means for holding said housing within said cutout portion maintaining said shoulder engaged with said inner surface and said upper portion of said housing exteriorly exposed.

2. A reading stand as recited in claim 1 wherein said first panel group further includes a rear panel adjacent to said frontal panel and including a free bottom edge opposite said hinge means between said rear panel and said frontal panel, said bottom edge being disposed in braced engagement with said adjustment means when said frontal panel is supported in one of said angular adjusted positions.

3. A reading stand as recited in claim 2 wherein said bottom edge of said rear panel is held in braced engagement with said adjustment means of said base panel by hook and loop fasteners.

4. A reading stand as recited in claim 3 wherein said hinge means includes a seam defining a hinge between said frontal panel and said support lip, said seam being held in braced engagement with said upper surface of said base panel by hook and loop fasteners.

5. A reading stand as recited in claim 4 wherein said first panel group includes a strap means, said strap means being structured and disposed to so that the pages of the reading materials are prevented from turning.

* * * * *